US006527371B2

(12) United States Patent
Yamazaki et al.

(10) Patent No.: US 6,527,371 B2
(45) Date of Patent: Mar. 4, 2003

(54) INK JET RECORDING HEAD, INK JET RECORDING DEVICE AND HEAD MANUFACTURING METHOD

(75) Inventors: Kenji Yamazaki, Ebina (JP); Masaki Kataoka, Ebina (JP); Yoshihisa Ueda, Ebina (JP); Michiaki Murata, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/854,625

(22) Filed: May 15, 2001

(65) Prior Publication Data

US 2001/0040608 A1 Nov. 15, 2001

(30) Foreign Application Priority Data

May 15, 2000 (JP) ..... 2000-142495

(51) Int. Cl.[7] ..... B41J 2/14; B41J 2/16; B41J 2/05

(52) U.S. Cl. ..... 347/50; 347/63

(58) Field of Search ..... 347/54, 56, 63, 347/40, 50, 41, 20, 57, 58

(56) References Cited

U.S. PATENT DOCUMENTS 5,992,978 A * 11/1999 Fujii et al. ..... 347/54

FOREIGN PATENT DOCUMENTS

| | | |
|---|---|---|
| JP | 61-230954 | 10/1986 |
| JP | 63-34152 | 2/1988 |
| JP | 6-183002 | 7/1994 |
| JP | 2888474 B2 | 2/1999 |
| JP | 11-245413 | 9/1999 |

* cited by examiner

*Primary Examiner*—John Barlow
*Assistant Examiner*—Michael S. Brooke
(74) *Attorney, Agent, or Firm*—Morgan, Lewis & Bockius LLP

(57) ABSTRACT

The present invention provides an ink jet recording head in which the degree of freedom in the design of the arranged position of an electric signal input-output terminal is enhanced, its manufacturing method and an ink jet recording device, the invention is characterized as follows. The ink jet recording head is formed by laminating a heater element substrate in which a heater element and others are arranged and a passage substrate in which nozzles and others are formed. When the nozzles and others are formed by etching in the passage substrate, a cut-out portion for exposing an electric signal input-output terminal of the heater element substrate is also formed. Therefore, the degree of freedom in the design of the shape and the position of the cut-out portion in the head chip is enhanced. It is possible to prevent a hydrophobic agent from adhering to the electric signal input-output terminal to result in electric connection failure if hydrophobic treatment is applied to a nozzle forming plane by forming the head chip so that the electric signal input-output terminal is not exposed at least on the side of the nozzle forming plane owing to the cut-out portion.

5 Claims, 17 Drawing Sheets

SIGNAL PROCESSING CIRCUIT
DRIVER CIRCUIT 32
33
52
32
24
50
62

22A
26D
26C
34H
34H
20A
54
64
58(56)
62
50
60
54
64

50
54
64
62

INK JET RECORDING HEAD, INK JET RECORDING DEVICE AND HEAD MANUFACTURING METHOD

BACKGROUND OF THE INVENTION

1. Field of the Invention

The present invention relates to an ink jet recording head, a method of manufacturing it and an ink jet recording device.

2. Description of the Related Art

Recently, an ink jet recording device is drawing attention as a low-cost quality color recording device. A head chip which is an ink jet recording head is fastened to the end of the ink jet recording device and ink droplets are jetted from the head chip.

As shown in FIGS. 14B and 14C and FIG. 15, in a head chip 100, plural individual passages 102 communicating with each nozzle 104, a common liquid chamber 106 communicating with each individual passage 102 and a communicating port 110 for supplying ink to the common liquid chamber 106 from an ink tank and others are formed.

The head chip 100 is formed by joining a passage substrate 120 (see FIG. 16C) in which the individual passage 102, the common liquid chamber 106 and others are formed and a heater element substrate 126 (see FIG. 16A) in which a heater element 108, a signal processing circuit 122 for driving the heater element 108 and a driver circuit 124 are formed.

Referring to FIGS. 16, a method of manufacturing the head chip 100 made up as described above in a conventional example will be described below.

Technique for isolating into a chip to be a head chip after two silicon substrates for example are joined with a resin layer between them is disclosed in Japanese Published Unexamined Patent Application No. Sho 61-230954.

The heater element substrate 126 can be formed using LSI manufacturing technology and LSI manufacturing facilities for example. First, as shown in FIG. 16A, a heater layer to be a heat storage layer and a heater element, a protective layer for preventing the heater element 108 from being damaged by the pressure of bubbles generated by the heat of the heater element and others are laminated on a monocrystalline silicon wafer 128. Next, for a protective layer against ink, a resin layer 130 such as photosensitive polyimide is laminated. An opening (not shown) for at least the heater element 108 and an electric signal input-output terminal 132 is provided to the resin layer 130. Further, to form the individual passage 102 and a part of the common liquid chamber 106, a second resin layer 131 is formed as shown in FIG. 16B.

In the meantime, for forming the passage substrate 120, first, grooves 106A and 102A to be the common liquid chamber 106 and the individual passage 102 are formed on a silicon wafer 133 having a crystal face of <100> by, for example, anisotropic etching (see FIG. 16C). For forming the grooves 106A and 102A by anisotropic etching, as described in Japanese Published Unexamined Patent Application No. Hei 11-245413 and Japanese Published Unexamined Patent Application No. Hei 6-183002, after an etching mask is patterned on the silicon wafer 133 which has a crystal face of <100> on the surface, the grooves 106A and 102A can be precisely formed by etching using heated aqueous solution of potassium hydroxide (KOH).

Further, an adhesive 135 thinly applied on a film by spinning coating and others is selectively transferred on a convex portion of a composition plane on which the grooves 106A and 102A are formed for the silicon wafer 133 using a method proposed in Japanese Published Unexamined Patent Application No. Sho 63-34152 and others as shown in FIG. 16D.

Next, the silicon wafer 128 and the silicon wafer 133 are precisely aligned using an alignment mark 150 provided in units of wafer by a substrate aligner so that the heater element 108 and the groove 102A for the individual passage 102 are opposite and are heated at approximately 200° C. for four hours, applying pressure by a vacuum heating and pressure device. As a result, the applied adhesive 134 is cured, and the silicon wafer 128 and the silicon wafer 133 are bonded as shown in FIG. 16E.

Further, a bonded body 156 in which the silicon wafer 128 and the silicon wafer 133 are bonded is diced and isolated in units of chip by a dicing method described in U.S. Pat. No. 2,888,474 and multiple head chips 100 are simultaneously manufactured as shown in FIG. 16F.

In this case, as shown in FIG. 14A, first, an opening 142 is formed in the silicon wafer 128 by machining along a dicing line 140. As a result, the electric signal input-output terminal 132 formed on the silicon wafer 128 (the heater element substrate 126) is exposed outside as shown in FIG. 17. Next, the length of the individual passage 102 (the nozzle) in each head chip 100 is provided by machining the bonded body 156 along the dicing line 144. Finally, the bonded body is diced and isolated into an individual head chip 100 by machining the bonded body 156 along the dicing line 146.

In the head chip 100 formed as described above, as shown in FIGS. 14B and 14C and FIG. 15, the cut-out portion 134 is formed at the back 120B on the reverse side to a nozzle forming plane 120A on which nozzles 104 are formed in the passage substrate 120 and the electric signal input-output terminal 132 formed on the heater element substrate 126 is exposed outside from the opening of the resin layer 130.

The head chip 100 formed as described above is fastened to a heat sink 136 for outgoing radiation as shown in FIG. 15. A printed wiring substrate 138 is also formed on the heat sink 136, power and a signal supplied from the body of the ink jet recording device are transmitted to the heater element substrate 126 via a bonding wire 141, and a signal and others from various sensors provided to the heater element substrate 126 are transmitted to the body of the recording device.

As shown in FIGS. 18, in the head chip 100, if the electric signal input-output terminal 132 is formed at both ends in a nozzle arrangement direction (the longitudinal direction of the chip) in which the nozzles are arranged, dicing along a dicing line 154 for forming the cut-out portion is performed in addition to dicing along a dicing line 152 for dicing the head chip and isolating into each chip as dicing along the shorter direction of the chip so as to expose the electric signal input-output terminal 132 at both ends.

As described above, in a method of manufacturing the head chip 100 in the conventional example, the electric signal input-output terminal 132 is exposed outside by machining the passage substrate 120 in which the grooves are formed by dicing. Therefore, the shape of the cut-out portion (the exposed part) is linear and there is a problem that the shape of the cut-out portion (the exposed part) 134 of the head chip 100 is limited. That is, there is a problem that not only the arrangement of the electric signal input-output terminal 132 but the inside structure of the chip are restrained depending upon the shape of the cut-out portion 134.

Also, as shown in FIG. 18B, if the cut-out portion 134 for the electric signal input-output terminal 132 is formed at both ends in the longitudinal direction (the nozzle arrangement direction) of the head chip 100, the electric signal input-output terminal 132 is exposed on the side of the nozzle forming plane 120A and there may occur a problem that a hydrophobic agent adheres to the electric signal input-output terminal 132 by hydrophobic treatment for the nozzle forming plane 120A to disable electric connection. Also, in a process for sealing the electric signal input-output terminal 132, there may occur a problem that sealer is forced out from the electric signal input-output terminal 132 to the nozzle forming plane 120A.

SUMMARY OF THE INVENTION

The present invention has been made to solve the problems and provides an ink jet recording head in which the degree of freedom in the design of the arranged position of an electric signal input-output terminal is enhanced, its manufacturing method and an ink jet recording device.

According to an aspect of the present invention, the ink jet recording head which is formed by laminating a first substrate and a second substrate and inside of which an ink jetting mechanism is mounted includes a nozzle forming plane of the first substrate having a nozzle for jetting ink, a cut-out plane of the first substrate defining a cut-out portion at an end thereof, the cut-out portion not penetrating the substrate, and the cut-out plane being opposite to the nozzle forming plane, and an electric signal input-output terminal for electrically connecting to an external device, the terminal being formed on the second substrate at a face joining to the first substrate. The electric signal input-output terminal is exposed to the outside by forming the cut-out portion and is surrounded by facets forming the cut-out portion.

Since the electric signal input-output terminal is exposed outside by the cutout portion formed at the back of the nozzle forming plane in the first substrate, electric connection to an external device is facilitated.

In addition, the electric signal input-output terminal is surrounded by the facets forming the cut-out portion at the back of the nozzles and it is possible to securely prevent a hydrophobic agent from adhering to the electric signal input-output terminal when hydrophobic treatment is applied to the nozzle forming plane to result in electric connection failure.

According to another aspect of the present invention, the ink jet recording head which is formed by laminating a first substrate and a second substrate and inside of which an ink jetting mechanism is mounted includes a nozzle forming plane of the first substrate having a nozzle for jetting ink, a side plane continuing to the nozzle forming plane, the side plane defining a cut-out portion leaving a region continuing to the nozzle forming plane, and an electric signal input-output terminal for electrically connecting to an external device, the terminal being formed on the second substrate at a face joining to the first substrate. The electric signal input-output terminal is exposed to the outside by forming the cut-out portion.

As the electric signal input-output terminal is exposed outside by the cut-out portion formed on the side continuing to the nozzle forming plane in the first substrate, electric connection to an external device is facilitated.

In addition, since the cut is formed with the region left at least on the side of the nozzle forming plane on the side continuing to the nozzle forming plane in the first substrate, it is possible to securely prevent a hydrophobic agent from adhering to the electric signal input-output terminal to result in electric connection failure when hydrophobic treatment is applied to the nozzle forming plane.

According to another aspect of the present invention, a method of manufacturing an ink jet recording head in which plural ink jet recording heads are simultaneously manufactured using a wafer includes the steps of forming a through-hole together with a nozzle in a first area of a first wafer equivalent to a chip, joining a second wafer, provided with an electric signal input-output terminal in a second area equivalent to a chip, with the first wafer, and exposing the electric signal input-output terminal to the outside from the through-hole, and dicing and isolating a joined body composed of the first wafer and the second wafer in units of chip.

First, the ink jet recording head in which the electric signal input-output terminal is exposed outside can be efficiently manufactured by forming the through-hole to be a cut-out portion together with nozzles in the first area equivalent to a chip of the first wafer, joining the second wafer where the electric signal input-output terminal is formed in the second area equivalent to a chip and the first wafer and dicing and isolating the wafers into each chip. At this time, since the through-hole to be a cut-out portion is formed in the first area of the first wafer, dicing for forming the cut-out portion in the dicing and isolating process is not required and the manufacturing efficiency is enhanced.

In addition, since the through-hole to be a cut-out portion can be formed in the first area of the first wafer by a method different from dicing such as etching and laser beam machining, the cut-out portion can be formed in a desired position of the head so that it has a desired shape. That is, the degree of the freedom of design in the ink jet recording head is enhanced.

According to another aspect of the present invention, a method of manufacturing an ink jet recording head formed by laminating a first substrate having an individual passage for supplying ink to a nozzle, a common liquid chamber communicating with the individual passages and a through-hole for leading ink from the outside to the common liquid chamber and a second substrate in which a heater element opposite to the individual passage is formed, includes the steps of forming a groove not pierced from a first surface of the first substrate to a second surface on the reverse side by etching, and piercing the groove by thinning the substrate by etching or grinding from the second surface to form the through-hole in the common liquid chamber.

When the through-hole is formed in the first substrate, the strength of the first substrate is deteriorated, the handling of the first substrate becomes difficult and the first substrate may be broken. Then, in the invention, if a communicating port is provided to the common liquid chamber by grinding and others as a final machining process of the first substrate after the individual passage and the groove for a part of the common liquid chamber are simultaneously processed, the breakage and others of the substrate can be prevented.

Also, when a through-hole is formed in the first substrate before the individual passage is formed, gas for cooling leaks from the second surface to the first surface in processing the individual passage and the processing quality and the precision of the individual passage are deteriorated. Then, in the invention, the processing quality and the precision of the individual passage can be enhanced by forming an opening in a part of the common liquid chamber by thinning the substrate from the second surface after the individual passage is processed.

BRIEF DESCRIPTION OF THE DRAWINGS

Preferred embodiments of the invention will be described in detail based on the followings, wherein.

DETAILED DESCRIPTION OF THE PREFERRED EMBODIMENTS (First Embodiment)

Referring to FIGS. 1 to 5, an ink jet recording head equivalent to a first embodiment of the invention will be described below.

Figure 1A:
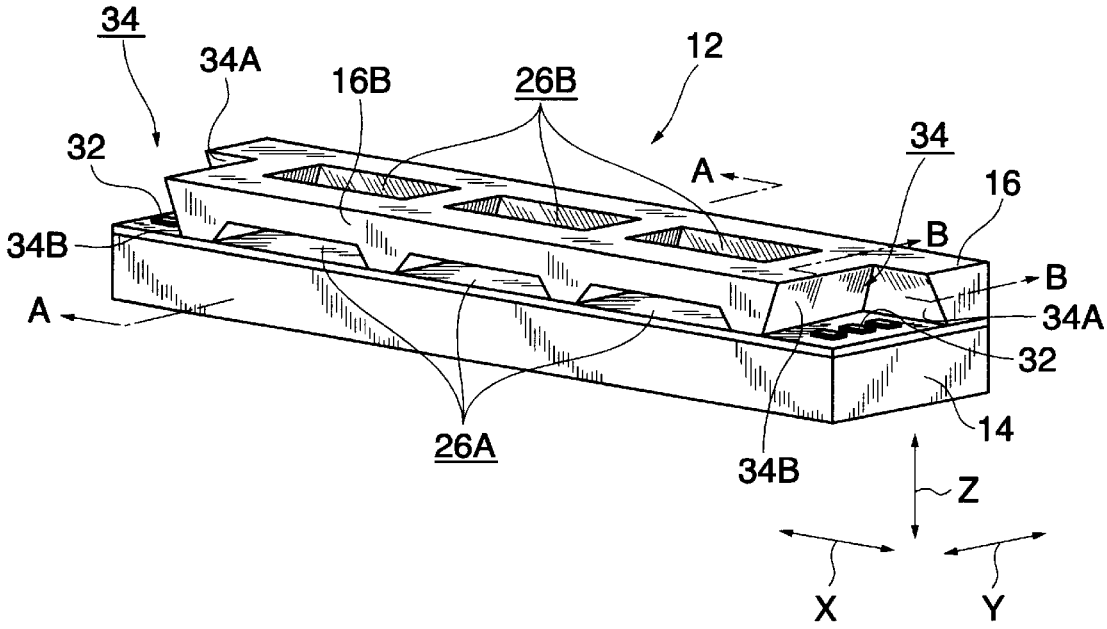
FIG. 1A is a perspective view showing the back side of a head chip equivalent to a first embodiment of the invention and FIG. 1B is a perspective view showing the front side of the head chip.
Figure 1B:
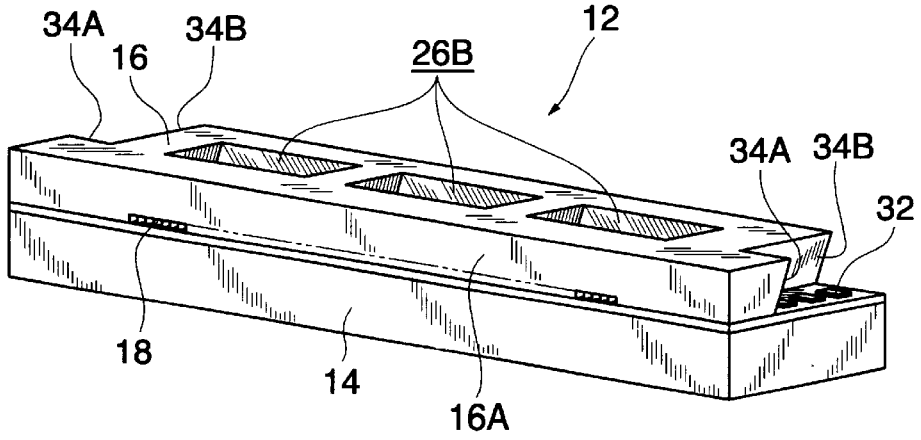
Figure 2:
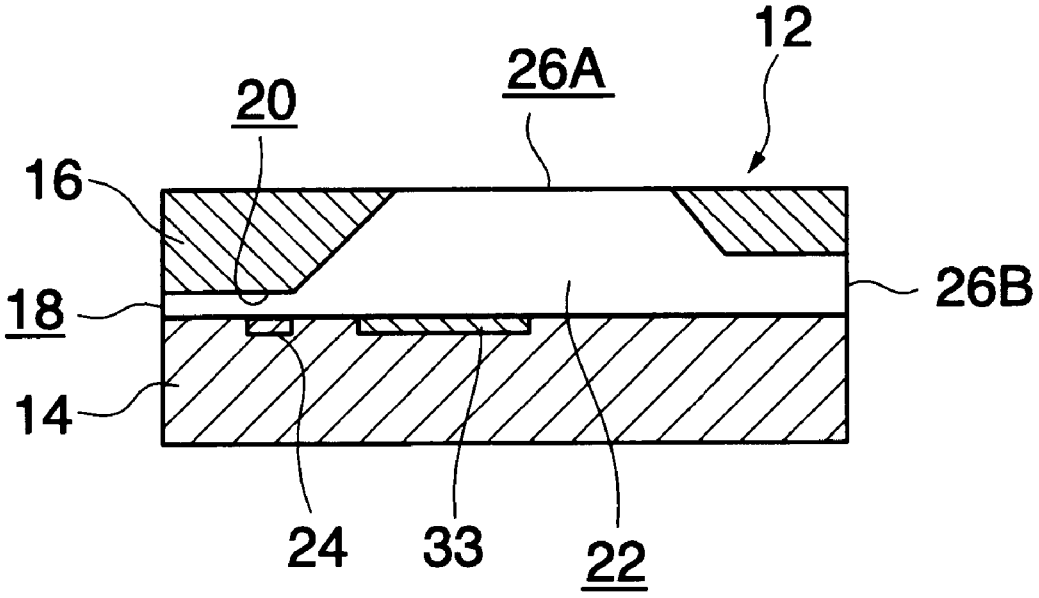
FIG. 2 is a sectional view viewed along the line A—A in FIG. 1A.
Figure 3A:
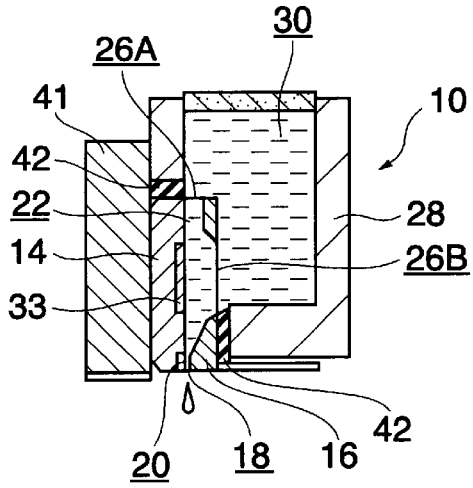
FIG. 3A is a longitudinal section showing an ink jet recording head in the first embodiment of the invention.
Figure 3B:
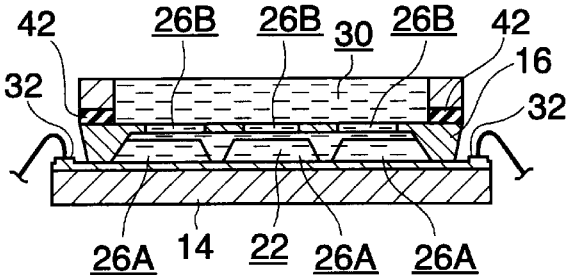
FIG. 3B is a sectional view showing the vicinity of the head chip of the ink jet recording head.
Figure 3C:
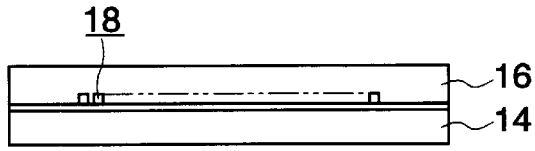
FIG. 3C is a front view showing the head chip.
Figure 3D:
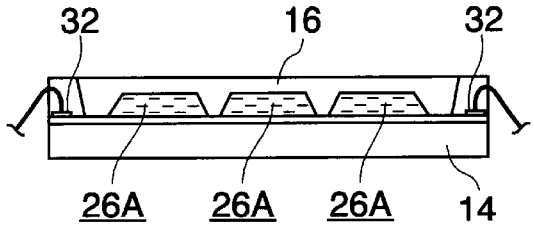
FIG. 3D is a back view showing the head chip and FIG. 3E is a plan showing the head chip.
Figure 3E:
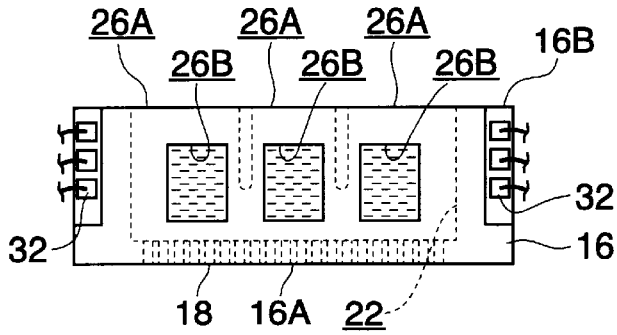

As shown in FIGS. 1A and 1B and FIG. 2, a head chip 12 forming the ink jet recording head 10 shown in FIG. 3A is formed by joining a heater element substrate 14 and a passage substrate 16 and is basically made up of plural nozzles 18 formed on one end face, an individual passage 20 communicating with the nozzle 18, a common liquid chamber 22 communicating with all the individual passages 20 and extended in a nozzle arrangement direction and a heater element 24 arranged opposite to the individual passage 20.

The common liquid chamber 22 communicates with each individual passage 20 and is connected to an ink subchamber 30 shown in FIG. 3A of an ink supply member 28 via a communicating port 26A open in a direction in which the individual passage 20 is extended (a direction shown by an arrow Y) and a communicating port 26B open in a direction perpendicular to the individual passage 20 (a direction shown by an arrow Z).

In the passage substrate 16, a cut-out portion 34 constructed by mutually perpendicular facets 34A and 34B is formed at both ends in a longitudinal direction on the back side 16B of a nozzle formation face 16A as shown in FIG. 1A, and an electric signal input-output terminal 32 provided to the heater element substrate 14 is exposed outside by the cut-out portion 34, which terminal can be electrically connected to an external device via wire bonding and others.

Also, a driver circuit 33 for driving the heater element 24 is provided to the side of the common liquid chamber 22 of the heater element substrate 14 as shown in FIG. 2.

The head chip 12 formed as described above communicates with the ink subchamber 30 of the ink supply member 28 via the communicating ports 26A and 26B by being pressed on the end of the ink supply member 28 via an elastic member 42 as shown in FIG. 3A. Therefore, ink is supplied from the ink subchamber 30 to the common liquid chamber 22 from two directions, ink is smoothly supplied and bubbles in the common liquid chamber 22 can be prevented from being moved to the ink subchamber 30 and preventing the supply of ink by arranging either of the communicating ports 26A or 26B on the upside in a direction of gravity.

Also, the head chip 12 is supported and the heat is radiated by a heat sink 41 and controls the heater element 24 when the electric signal input-output terminal 32 is electrically connected to an electric circuit provided on the heat sink via wire bonding.

A method of manufacturing the head chip 12 formed as described above will be described below.

Figures 4A, 4B, 4C, 4D, 4E:
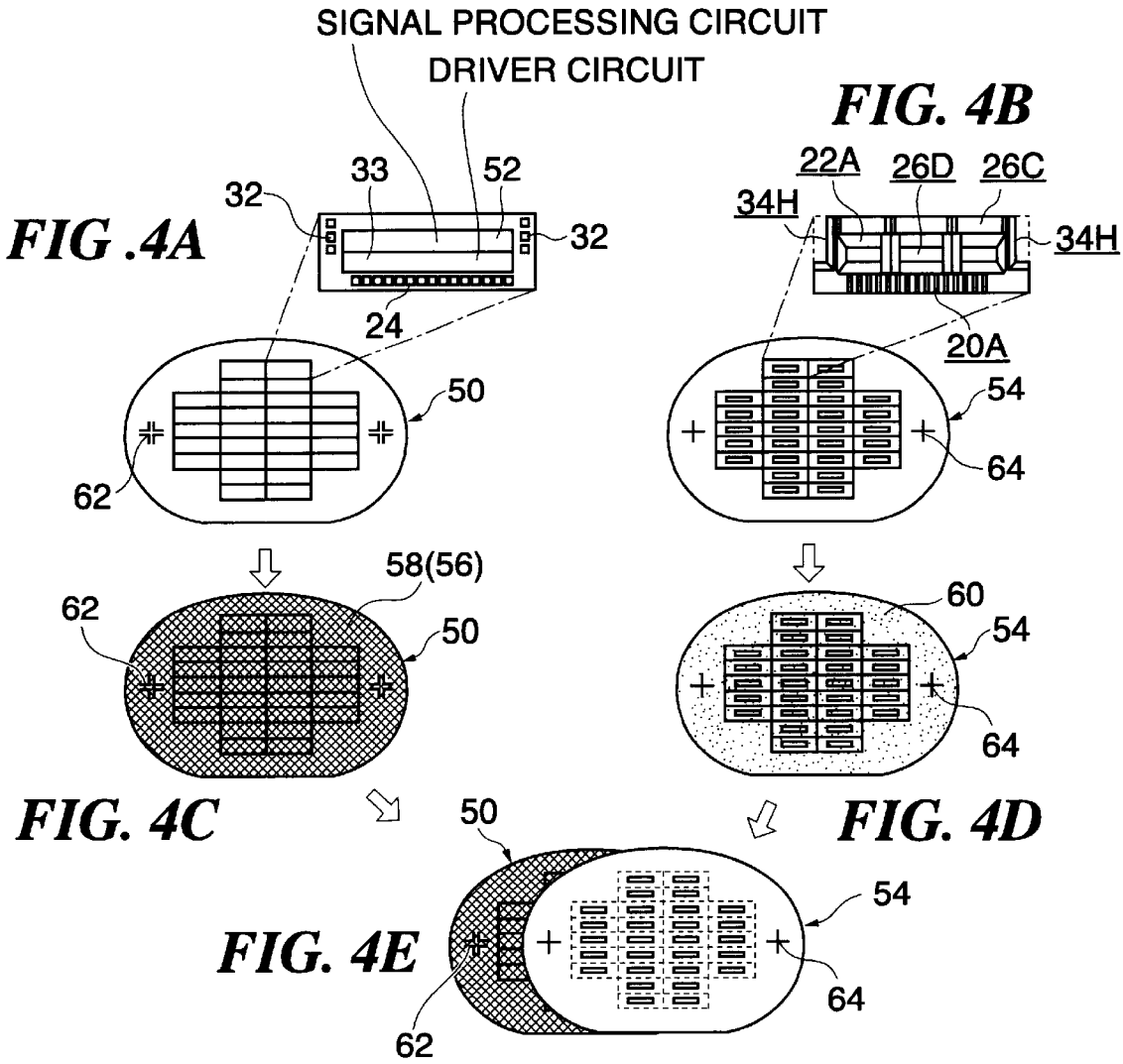
FIGS. 4A to 4E are explanatory drawings showing a method of producing the head chip equivalent to the first embodiment of the invention.

Plural chips each of which is equivalent to the heater element substrate 14 made up of the electric signal input-output terminal 32, the heater element 24, the driver circuit 33, a signal processing circuit 52 and electric wiring (not shown) connecting them are produced on a silicon wafer 50 according to a process for LSI as shown in FIG. 4A.

In the meantime, not only a groove 26C for the communicating port 26A shown in FIG. 1A by anisotropic etching (ODE) technology, a through-hole 26D for the communicating port 26B shown in FIG. 1A and a groove 20A for the individual passage 20 to be formed but a through-hole 34H for the cut-out portion 34 are similarly formed on a silicon wafer 54 as shown in FIG. 4B.

Figure 5:
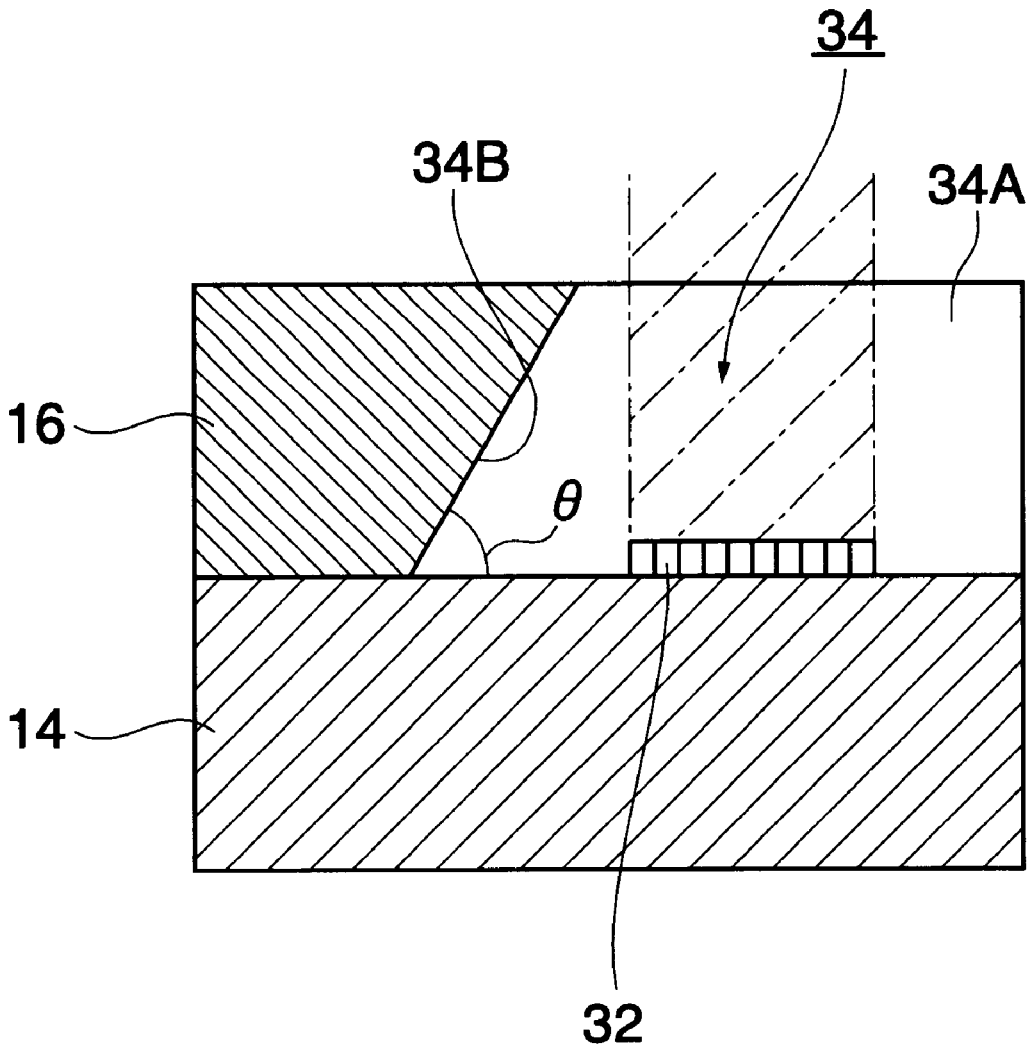
FIG. 5 is a sectional view viewed along the line B—B in FIG. 1A.
Figure 6:
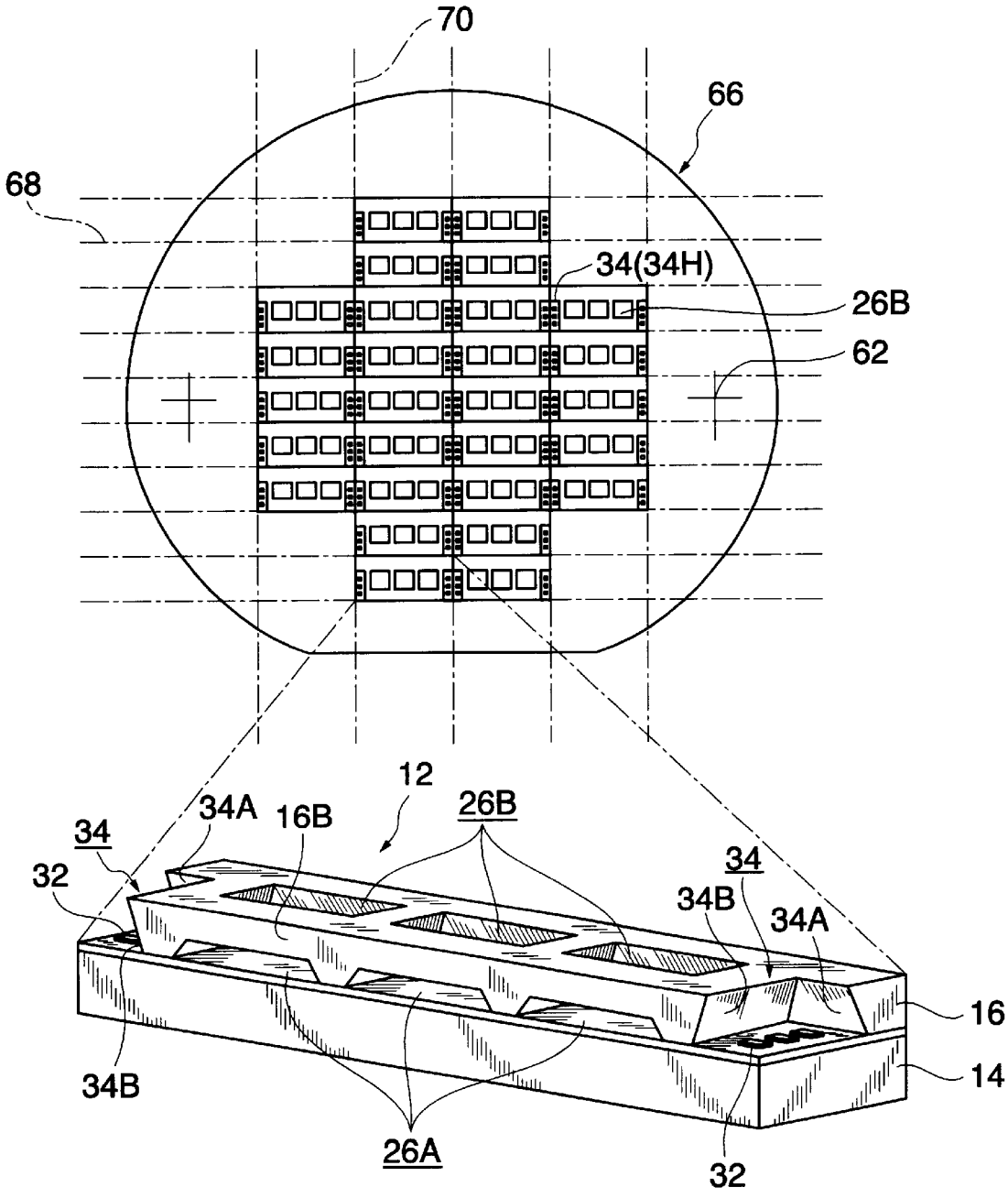
FIG. 6 is an explanatory drawing showing a method of manufacturing the ink jet recording head in the first embodiment of the invention.

At this time, an angle θ with the composition plane of the heater element substrate 14 is acute as shown in FIG. 5 because the facets 34A and 34B of the cut-out portion 34 are formed by anisotropic etching (ODE) technology. Then, the through-hole 34H shown in FIG. 6 is formed so that the facets 34A and 34B are not located on the upside (the vertical upside) of the electric signal input-output terminal 32 to facilitate the electric connection of the electric signal input-output terminal 32 after the head chip 12 is produced.

Next, a first resin layer 56 as a protective layer against ink is formed on the side of a composition plane (a face on which the groove 20A for the individual passage 20 is provided) on which the heater element 24 of the heater element substrate 14 is provided. An opening (not shown) for at least the heater element 24 and the electric signal input-output terminal 32 is provided in the resin layer 56. Next, a second resin layer 58 is formed to form a part of the individual passage 20 and a part of the nozzle 18 as shown in FIG. 4C. In this case, the resin layers 56 and 58 precisely registered on the heater element substrate 14 can be acquired by using a photosensitive resin of which the patterning process is simple (trade name: Probimide 7520, Probimide HTR3-200, Photonees UR5100 FX and Lthocoat PI-400) via a process of application, prebaking, exposure, baking, development and curing. Though its extent is different depending upon the thickness and the material of the resin layers 56 and 58, the resin layers in the vicinity of a patterning edge are convex because of the contraction of the films in the curing process, compared with the other region. To improve such irregularities, processing for flattening the resin layers by CMP is executed.

In the meantime, on the silicon wafer 54, an adhesive 60 thinly applied on a film by spinning coating is selectively transferred on the convex portion on the composition plane using a method proposed in Japanese Published Unexamined Patent Application No. Sho 63-34152 and others as shown in FIG. 4D.

The silicon wafer 50 and the silicon wafer 54 are precisely registered as described above using alignment marks 62 and 64 by a substrate aligner so that the heater element 24 and the groove 20A for the individual passage 20 are opposite and are temporarily fixed. The pair of wafers temporarily fixed is joined by heating at approximately 200° C. for approximately four hours, applying pressure by a vacuum heating and pressure device and curing the applied adhesive as shown in FIG. 4E (hereinafter, joined silicon wafers are called a joined body 66).

The silicon wafers may also be directly joined via a resin material by overlapping the silicon wafer 50 and the silicon wafer 54 and applying voltage in which the side of the silicon wafer 50 is a negative pole between both silicon wafers 50 and 54 under predetermined temperature environment as it is proposed in Japanese Patent Application No. Hei 11-312456.

After the silicon wafer 50 and the silicon wafer 54 are joined as described above, the joined body 66 is diced and isolated per head chip.

That is, as shown in FIG. 6, the joined body is diced and isolated along the longitudinal direction and the shorter direction of the head chip 12 by dicing along dicing lines 68 and 70. The jetting surface (a nozzle forming plane) of the head chip 12 is formed by dicing along the longitudinal direction and the length of the individual passage 20 (the nozzle 18) is provided. The through-hole 34H that ranges to an adjacent chip becomes two cut-out portions 34 shown in FIGS. 1 formed on the end face of each chip by dicing along the shorter direction.

The head chip 12 is acquired by dicing and isolating the joined body 66 per chip as described above.

The head chip 12 formed as described above is fixed to the heat sink for outgoing radiation 41 and an ink-repellent film is formed on the nozzle forming plane 16A. For the ink-repellent film, fluororesin (for example, Cytop: CTX105 and CTX805 respectively manufactured by Asahi Glass Co., Ltd.) and others may be used. A printed wiring substrate (not shown) formed on the heat sink 41 and the electric signal input-output terminal 32 are connected via wire bonding and others. This electric connecting method is not limited to wire bonding and may also be a connecting method using a tab (see FIG. 3).

Afterward, the electric signal input-output terminal 32 is sealed by sealer (for example, silicon resin, CR6182 manufactured by Dow Corning Toray) so that jetted ink is prevented from touching the terminal.

The action of the ink jet recording head 10 formed as described above will be described below.

In the ink jet recording head 10, to form the cut-out portion 34, when the groove 20A for the individual passage 20 and others are formed on the wafer 50 by etching, simultaneously the through-hole 34H for the cut-out portion 34 is formed. As described above, as the cut-out portion 34 is formed not by dicing but by etching and others, the degree of freedom in the design of the formation position and the shape of the cut-out portion 34 is enhanced.

As a result, in the ink jet recording head 10, the cut-out portion 34 can be formed at both ends in a nozzle arrangement direction (a direction shown by an arrow X) and the communicating port 26A can be provided on the back side 16B of the common liquid chamber 22. Therefore, ink supply toward the nozzle 18 is smooth and bubbles generated inside the common liquid chamber 22 are easily carried outside.

Also, since the facets 34A and 34B forming the cut-out portion 34 do not exist in an area (shown by an alternate long and short dash line in FIG. 5) on the vertical upside of the composition plane of the electric signal input-output terminal 32 formed in the head chip 12, electric connection to the electric signal input-output terminal 32 via wire bonding and others is facilitated. As the cut-out portion 34 is open in two directions, the degree of the freedom of electric connection is further enhanced.

Furthermore, in the ink jet recording head 10, the electric signal input-output terminal 32 is surrounded by the facets 34A and 34B forming the cut-out portion 34 and the facet 34A prevents the electric signal input-output terminal 32 from being exposed on the side of the nozzle forming plane 16A of the passage substrate 16. Therefore, even if a water-repellent agent (for example, fluororesin) is applied to the nozzle forming plane 16A to form an ink-repellent film when the head chip 12 is produced, it is possible to prevent the water-repellent agent from adhering to the electric signal input-output terminal 32 to result in electric connection failure. Therefore, stable electric connection can be secured. Conversely, if sealer is applied to the cut-out portion 34 (the electric signal input-output terminal 32), it is possible to prevent the sealer from spilling on the nozzle forming plane 16A to result in ink jetting failure of the nozzle 18.

Also, in a method of producing the head chip, since simultaneously the through-hole 34H for the cut-out portion 34 for exposing the electric signal input-output terminal 32 outside is also formed when the groove 22A for the common liquid chamber 22 and the grooves 26C and 26D for the communicating ports 26A and 26B are formed by etching, dicing for removing a part equivalent to the cut-out portion from the joined body 66 shown in FIG. 6 is not required and the production efficiency of the head chip 12 is enhanced.

Further, as the cut-out portion 34 is formed at both ends in the longitudinal direction of the head chip 12, the through-hole 34H of the silicon wafer 54 can be formed across an adjacent chip. As a result, two cut-out portions 34 can be simultaneously formed by dicing 70 for cutting along the shorter direction of the head chip 12. Therefore, the production efficiency of the head chip 12 is enhanced.

A method of etching the through-hole 26D and others in the method of producing the head chip 12 can also be as follows.

Figure 7:
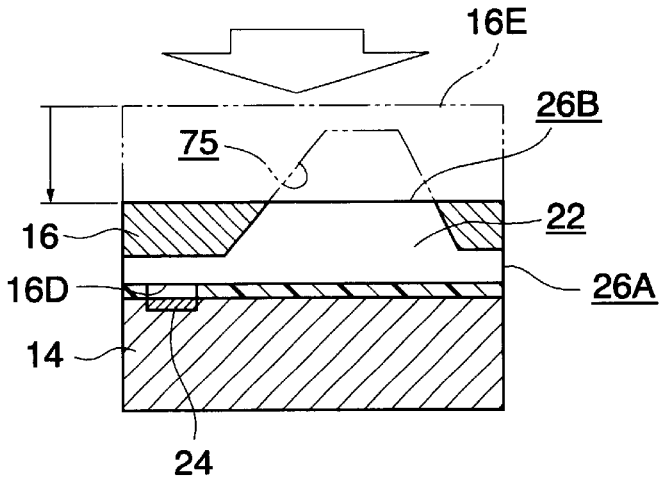
FIG. 7 is an explanatory drawing showing another embodiment of a method of producing the head chip according to the invention.

That is, as shown in FIG. 7, first, a groove 75 which is not through is formed from the side of the composition plane 16D in the passage substrate 16 by etching and others and afterward, the passage substrate 16 and the heater element substrate 14 are joined. Next, the groove 75 is pierced by reducing the thickness of the substrate from the rear 16E on the reverse side to the composition plane 16D of the passage substrate 16 by grinding or etching and others, and the common liquid chamber 22 and the communicating port 26B (the through-hole 26D shown in FIGS. 4) are formed.

According to this embodiment, the groove can be more stably pierced in a shorter time than a case where the groove is pierced from the side of the composition plane 16D through the passage substrate 16. Also, since the large communicating port 26B can be formed even if the head chip size is the same when the communicating port 26B is formed by ODE by thinning the substrate, the communicating port of a size which allows bubbles to be exhausted can be acquired even if chip size is reduced to thereby enhance the yield of heads. Further, an incidental effect is also acquired that a dicing and isolating process of the head chip becomes simple because the substrate is thinned.

In this embodiment, the head chip 12 in which the communicating ports 26A and 26B open to two directions are formed is described, however, they may also be open to one direction and the example that the communicating ports 26A and 26B, three of them each, are formed is described, however, the number of the communicating ports is not limited to three and one or more communicating ports may also be provided depending upon the application, the outside dimension of the chip and others.

(Second Embodiment)

Figure 8A:
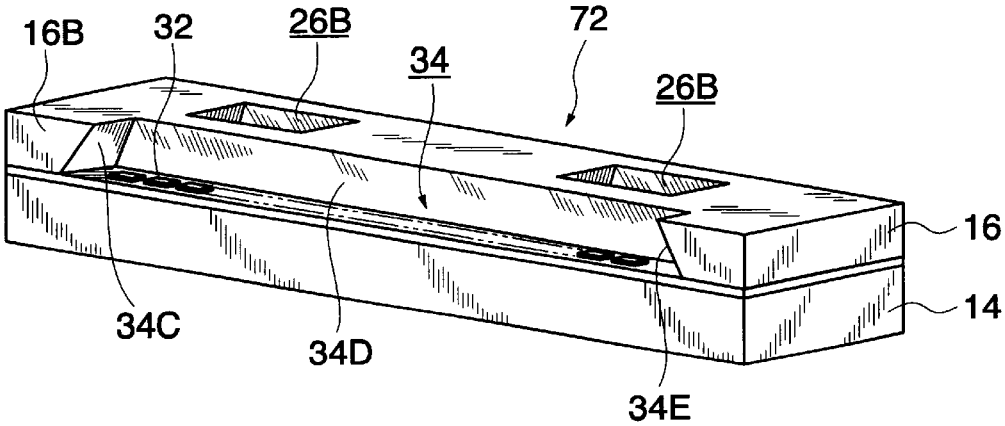
FIG. 8A is a perspective view showing the back side of a head chip equivalent to a second embodiment of the invention and FIG. 8B is a perspective view showing the front side of the head chip.
Figure 8B:
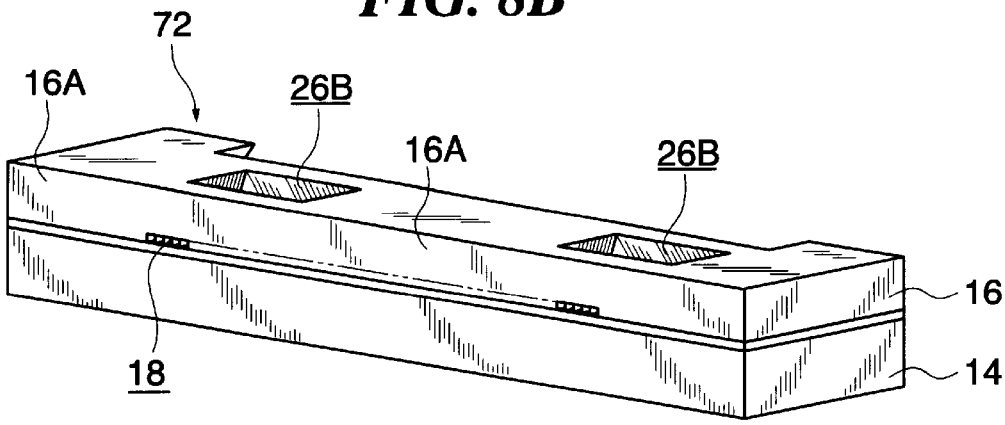

Next, referring to FIGS. 8, an ink jet recording head equivalent to a second embodiment of the invention will be described. The same reference numbers are allocated to the same components for those in the first embodiment and a detailed description is omitted.

A head chip 72 has the same configuration as that of the head chip 12 except that an electric signal input-output terminal 32 is formed on the back side of a heater element substrate 14 and is exposed outside by a cut-out portion 34 formed at the back 16B of a nozzle forming plane 16A so that the cut-out portion is surrounded from three directions.

Also, the cut-out portion 34 is formed on a silicon wafer 54 in units of chip (a passage substrate 16) by ODE together with communicating ports 26A and 26B and others as in the first embodiment. In a dicing process, the cut-out portion is formed by dicing for dicing and isolation along the longitudinal direction in this embodiment.

The action of the head chip 72 formed as described above will be described below.

As in the head chip 72, the cut-out portion 34 surrounded from three directions by the facets 34C to 34E is formed on the back side 16B, it is possible to prevent a water-repellent agent from adhering to the electric signal input-output terminal 32 exposed in the cut-out portion 34 to result in electric connection failure when the water-repellent agent is applied to the nozzle forming plane 16A during of the production of the head chip 72. It is also possible to prevent sealer applied to the electric signal input-output terminal 32 from spilling on the nozzle forming plane 16A to result in ink jetting failure of the nozzle.

Figure 9A:
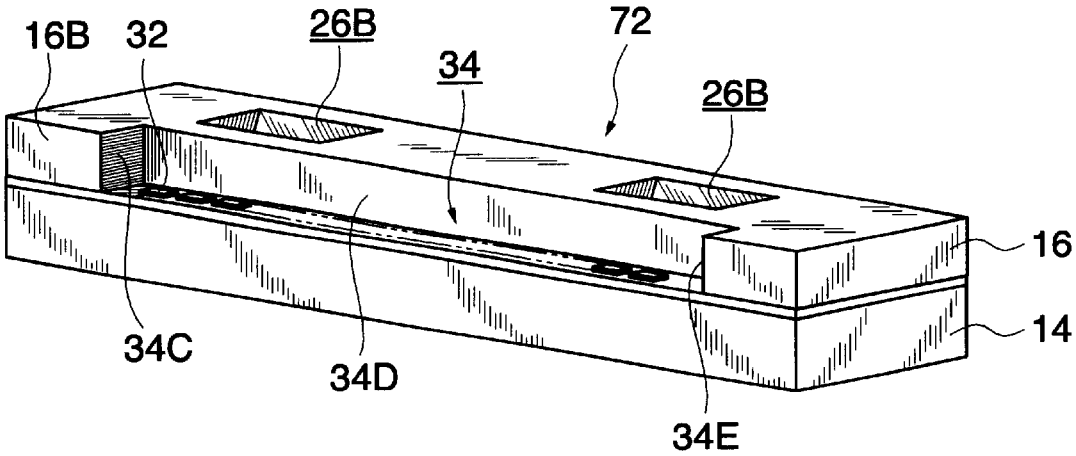
FIG. 9A is a perspective view showing the back side of a head chip equivalent to another embodiment of the invention and FIG. 9B is a perspective view showing the front side of the head chip.
Figure 9B:
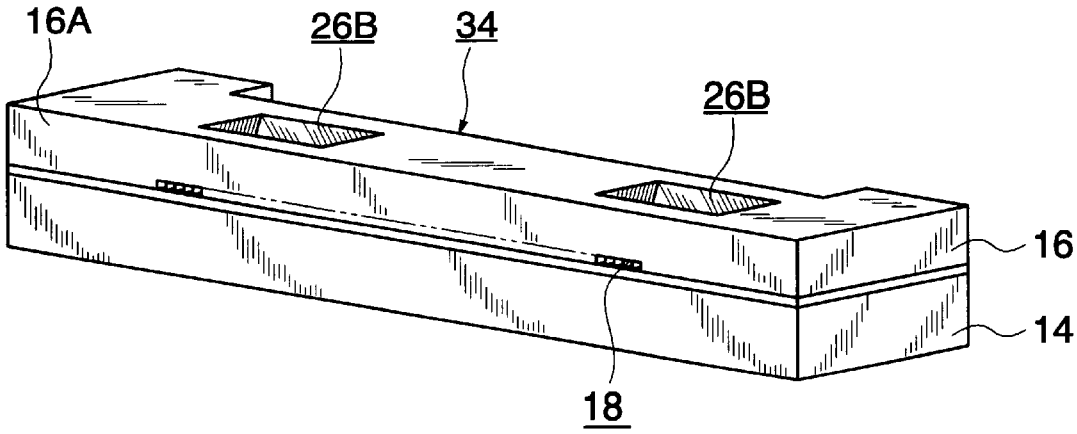

A method of forming the cut-out portion 34 is not limited to ODE and may also be another method. For example, another method has an advantage that the facets 34C to 34E forming the cut-out portion 34 are perpendicular to the heater element substrate 14 by forming the cut-out portion 34 by laser beam machining and the electric signal input-output terminal 32 can be securely exposed as shown in FIGS. 9.

(Third Embodiment)

Figure 10A:
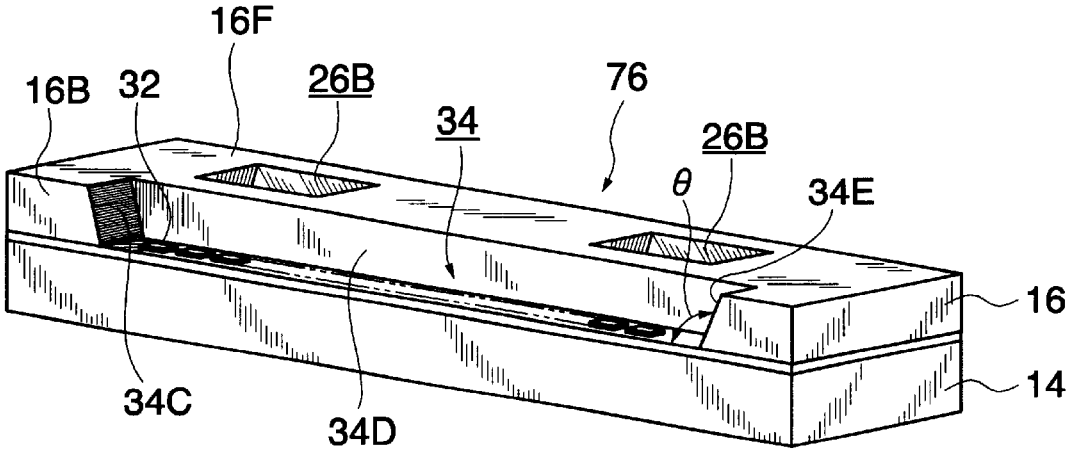
FIG. 10A is a perspective view showing the back side of a head chip equivalent to a third embodiment of the invention and FIG. 10B is a perspective view showing the front side of the head chip.
Figure 10B:
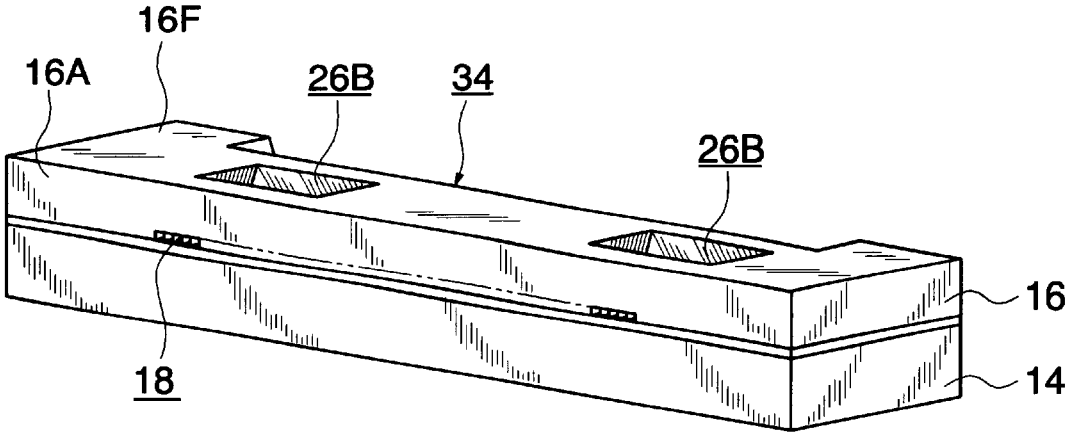

Referring to FIGS. 10A and 10B, a third embodiment of the invention will be described below. The same reference numbers are allocated to the same components for those in the first and second embodiments and a detailed description is omitted.

A method of producing a head chip 76 in this embodiment is also similar to that in the first embodiment, however, when a cut-out portion 34 (a through-hole 34H) is formed during the production of the head chip, at least the through-hole 34H is formed from the top face 16F by ODE. As a result, an angle θ of the facets 34C to 34E of the cut-out portion 34 with an exposed part of the heater element substrate 14 is an obtuse angle.

The action of the head chip 76 formed as described above will be described below.

The same action and effect to those in the first embodiment are produced and the facets 34C to 34E are not located on the upside (on the vertical upside of the composition plane) of the electric signal input-output terminal by setting the angle θ between the facets 34C to 34E of the cut-out portion 34 and the heater element substrate 14 to an obtuse angle. Therefore, electric connection to the electric signal input-output terminal 32 exposed by the cut-out portion 34 via wire bonding and others is further facilitated.

(Fourth Embodiment)

Figure 11A:
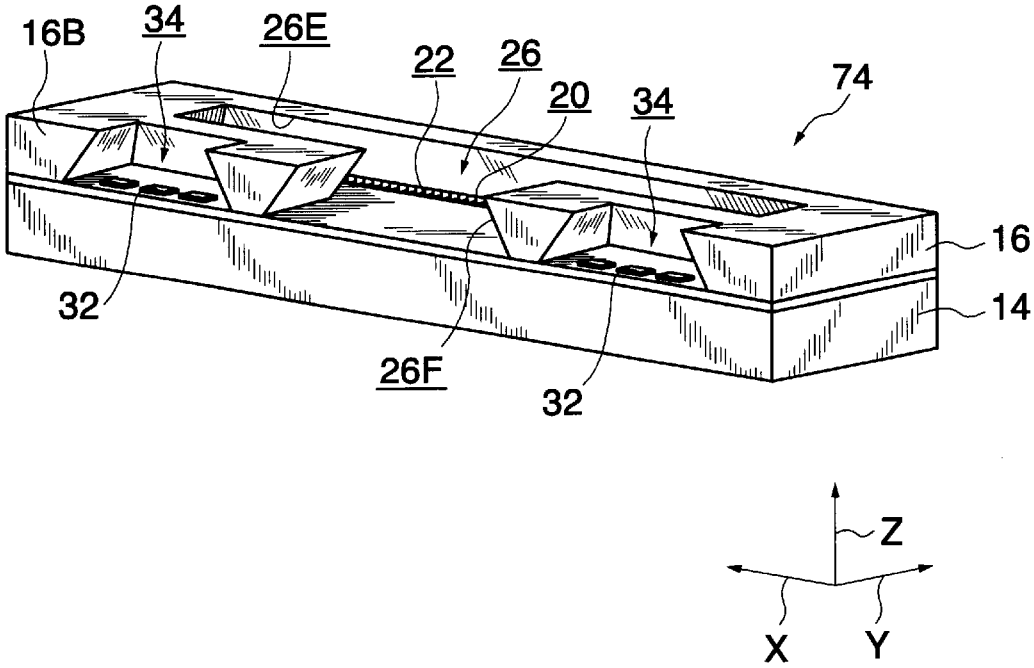
FIG. 11A is a perspective view showing the back side of a head chip equivalent to a fourth embodiment of the invention and FIG. 11B is a perspective view showing the front side of the head chip.
Figure 11B:
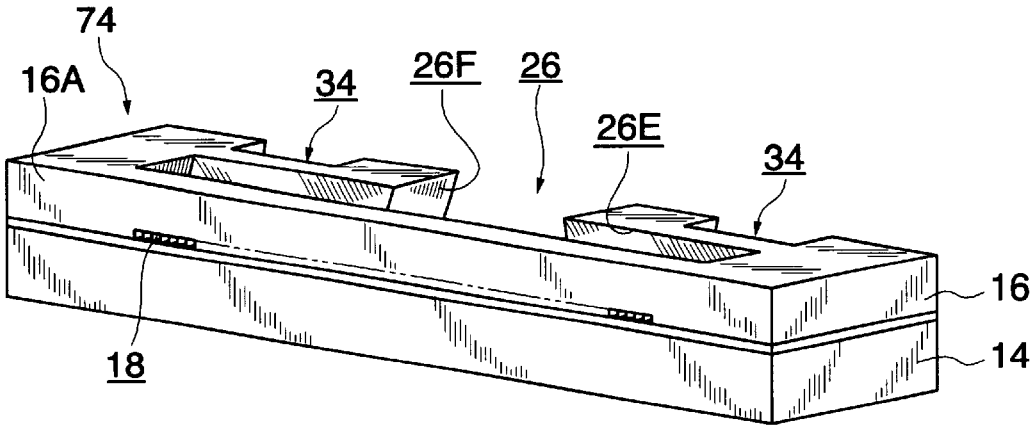

Referring to FIGS. 11A and 11B, a head chip equivalent to a fourth embodiment of the invention will be described below. The same reference numbers are allocated to the same components for those in the first to third embodiments and a detailed description is omitted.

A head chip 74 is provided with cut-out portions 34 which are a pair of concave portions to the back 16B of a nozzle forming plane 16A of a passage substrate 16 as shown in FIGS. 11A and 11B and is provided with an electric signal input-output terminal 32 on a heater element substrate 14 exposed by the cut-out portion 34. In the meantime, a communicating port 26 provided to a common liquid chamber 22 of the head chip 74 is open to a direction perpendicular to an individual passage 20 (a direction shown by an arrow Z) and is open to a direction in which the individual passage 20 is extended (a direction shown by an arrow Y) between the pair of cut-out portions 34. Assuming that, of parts forming the communicating port 26, a part open to the direction shown by the arrow Z is a first opening 26E and a part open to the direction shown by the arrow Y is a second opening 26F, ink can be supplied to the common liquid chamber 22 from two perpendicular directions of the first opening 26E and the second opening 26F when the head chip 74 is attached to an ink supply member not shown and the same action and effect to those in the second embodiment are produced.

Also, the electric signal input-output terminal 32 can be formed in a position different from both ends in the longitudinal direction of the head chip 74 by providing the cut-out portion 34 by the same method as that in the first embodiment.

(Fifth Embodiment)

Figure 12A:
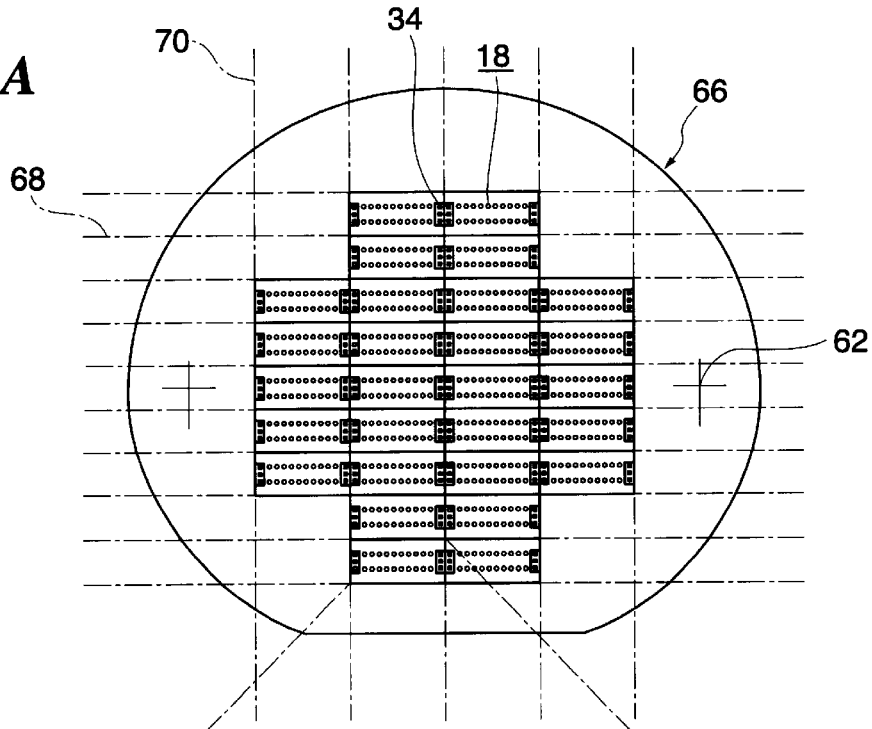
FIG. 12A is an explanatory drawing showing a method of producing a head chip equivalent to a fifth embodiment of the invention.
Figure 12B:
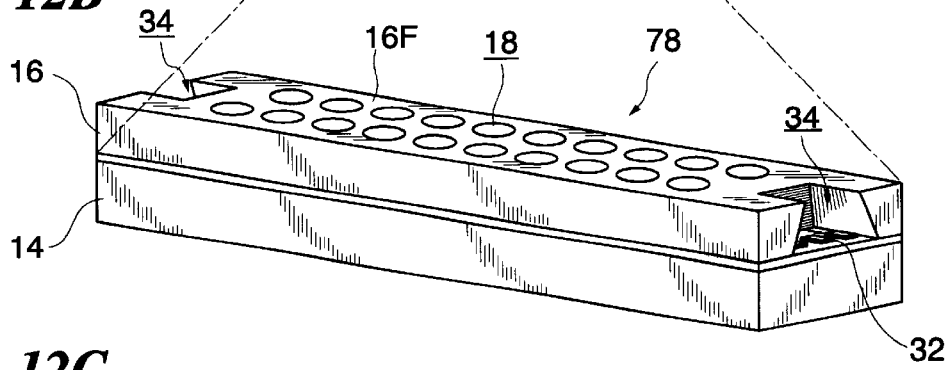
FIG. 12B is a perspective view showing the back side of the head chip equivalent to the fifth embodiment of the invention and FIG. 12C is a perspective view showing the front side of the head chip.
Figure 12C:
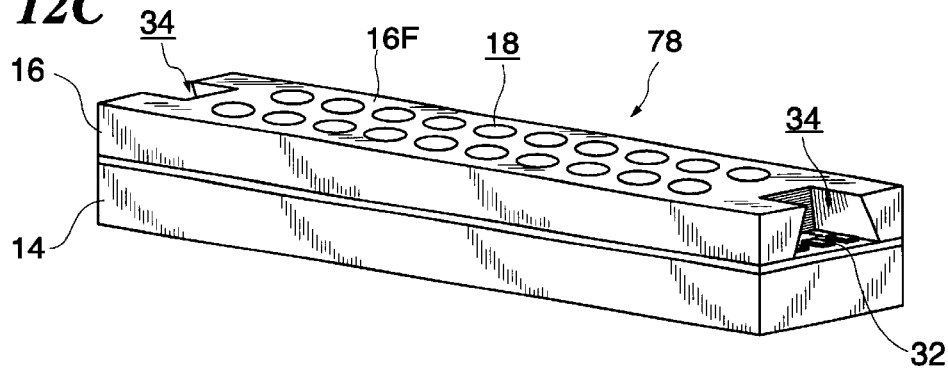

Referring to FIGS. 12, a fifth embodiment of the invention will be described below. The same reference numbers are allocated to the same components for those in the first to fourth embodiments and a detailed description is omitted.

In a head chip 78 of this embodiment, a nozzle 18 is formed on the upper surface 16F of the head chip 78. A cut-out portion 34 is formed at both ends in the longitudinal direction of the head chip 78.

A method of producing the head chip 78 formed as described above is substantially the same as that in the first embodiment, however, the nozzle 18 may also be formed by etching or may also be formed by laser beam machining.

As described above, a method of forming a cut-out portion according to the invention is not limited to the head chip in the shapes embodied in the first to fourth embodiments and can also be applied to a head chip in another shape.

(Sixth Embodiment)

Figure 13:
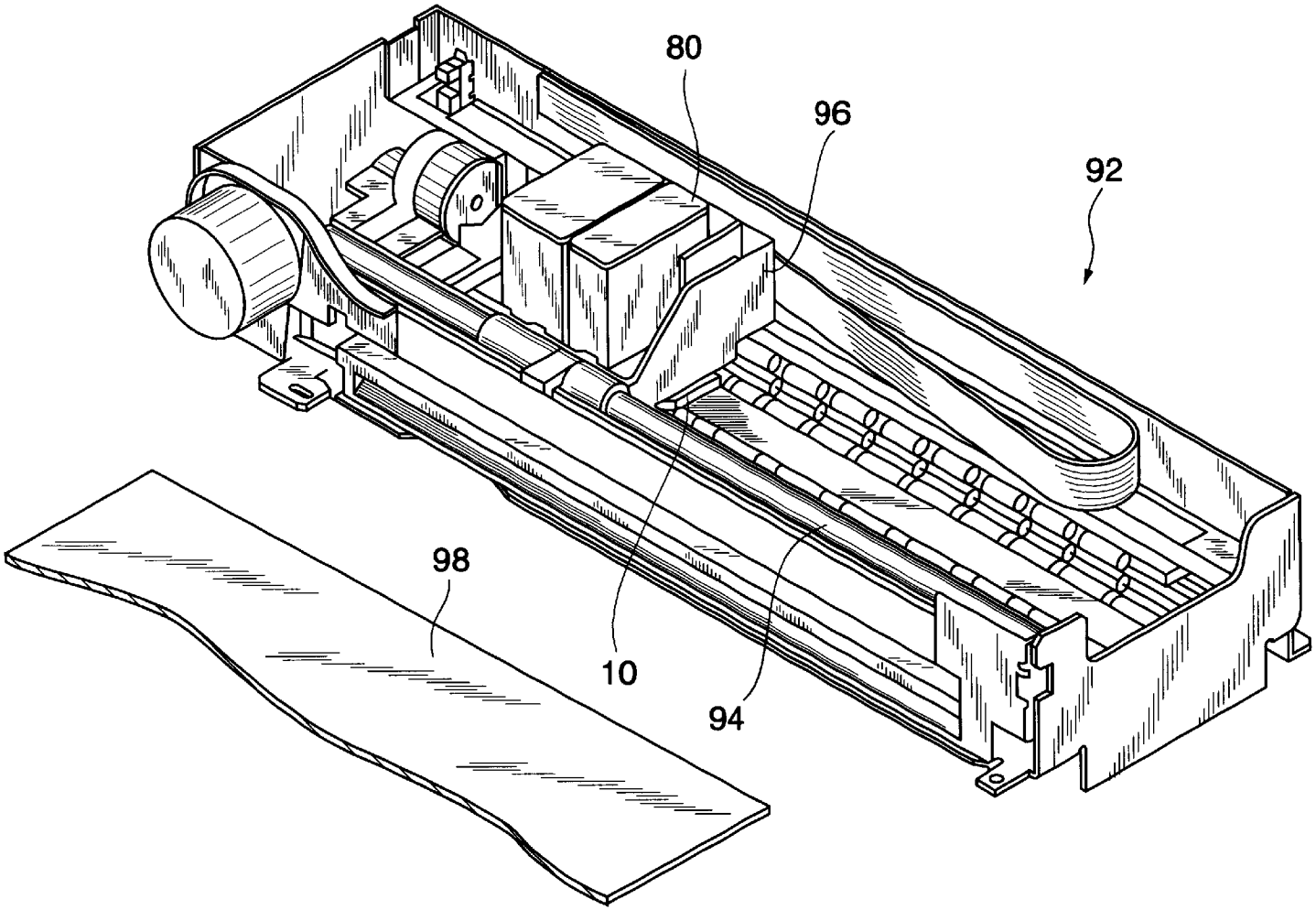
FIG. 13 is a perspective view showing an ink jet recording device equivalent to a sixth embodiment of the invention.
Figure 14A:
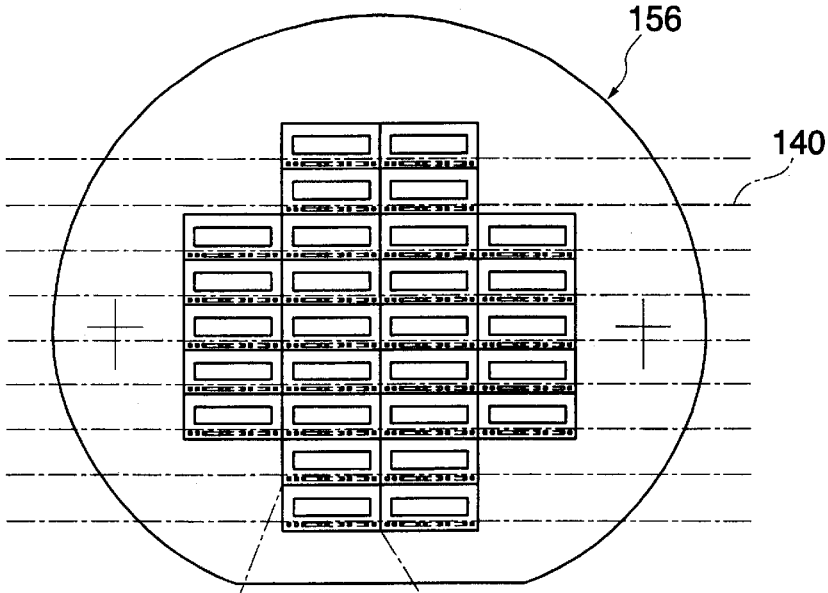
FIG. 14A PRIOR ART
FIG. 14A is an explanatory drawing showing a method of producing a head chip in a conventional example.
Figure 14B:
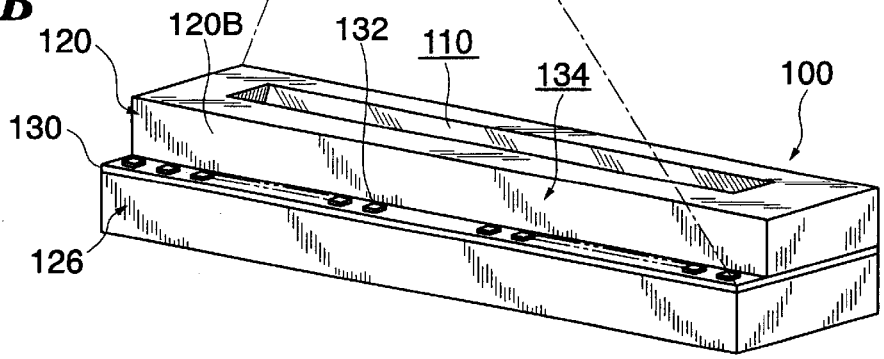
FIG. 14B PRIOR ART
FIG. 14B is a perspective view showing the back side of the head chip in the conventional example and FIG. 14C is a perspective view showing the front side of the head chip.
Figure 14C:
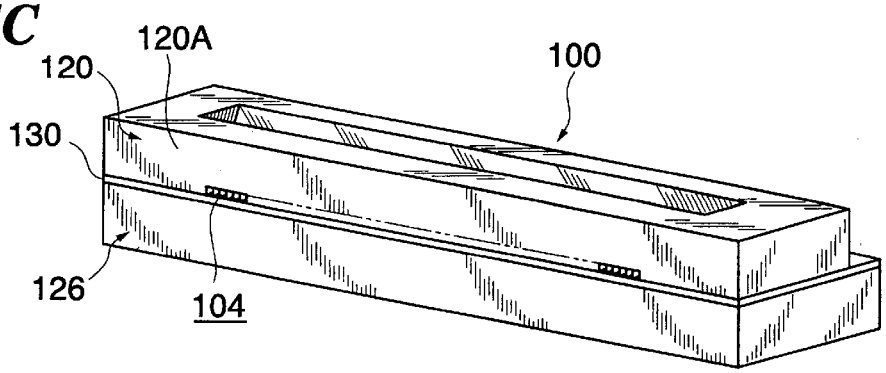
FIG. 14C PRIOR ART
Figure 15:
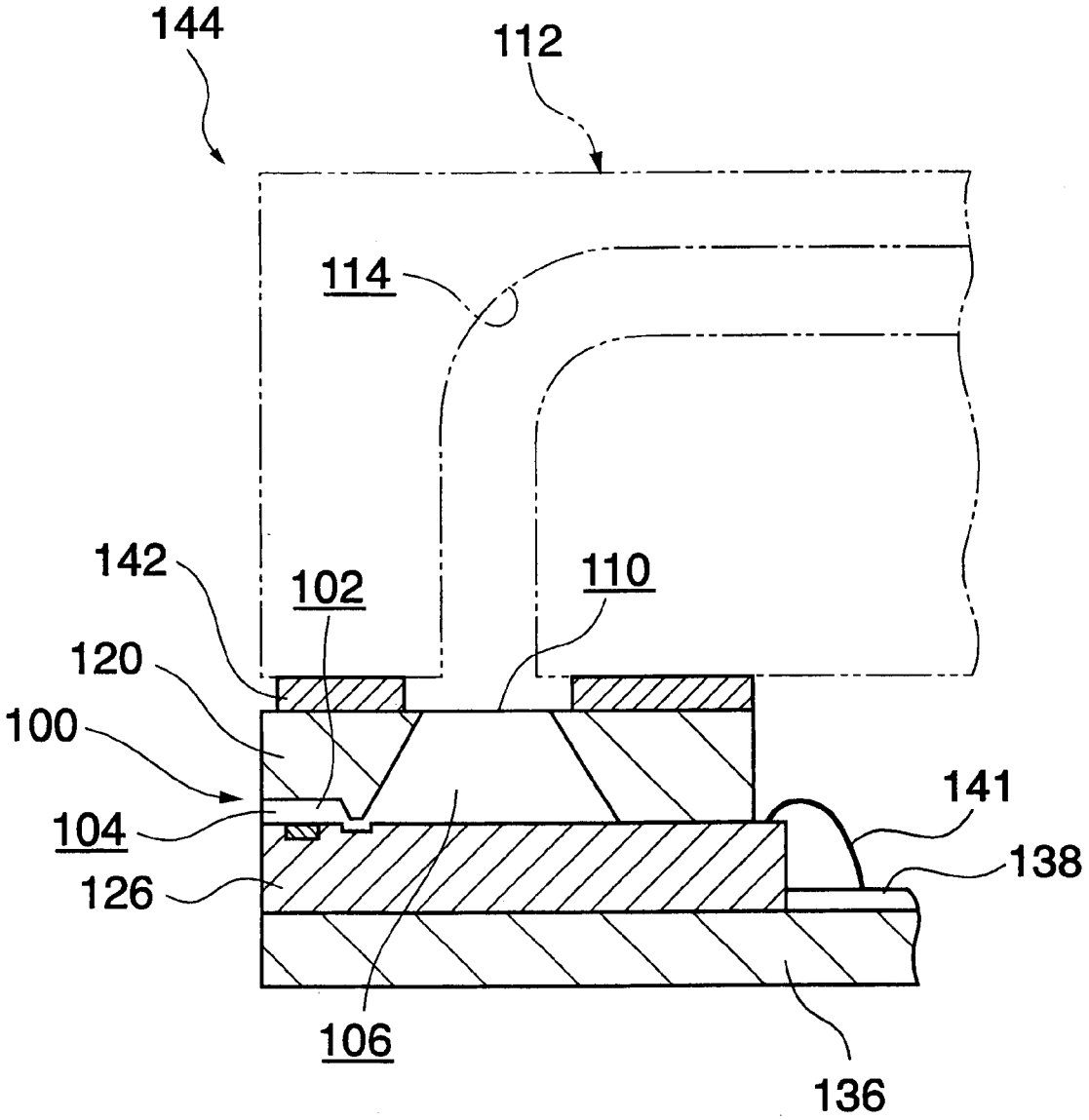
FIG. 15 PRIOR ART
FIG. 15 is a longitudinal section showing an ink jet recording head in the conventional example.
Figures 16A, 16B, 16C, 16D, 16E, 16F:
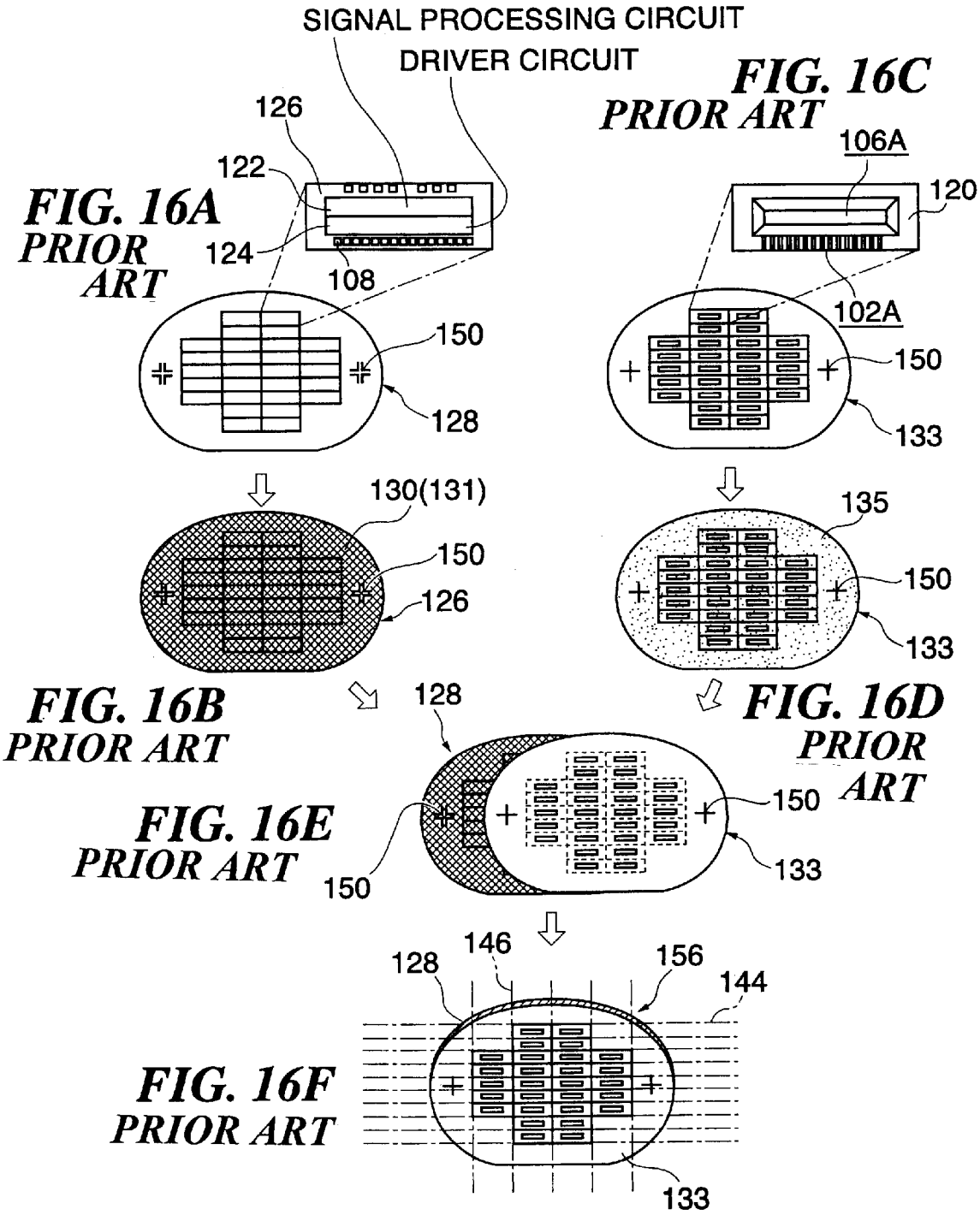
FIG. 16A PRIOR ART
FIG. 16B PRIOR ART
FIG. 16C PRIOR ART
FIG. 16D PRIOR ART
FIG. 16E PRIOR ART
FIG. 16F PRIOR ART
FIGS. 16A to 16F are explanatory drawings showing a method of producing a head chip in a conventional example.
Figure 17:
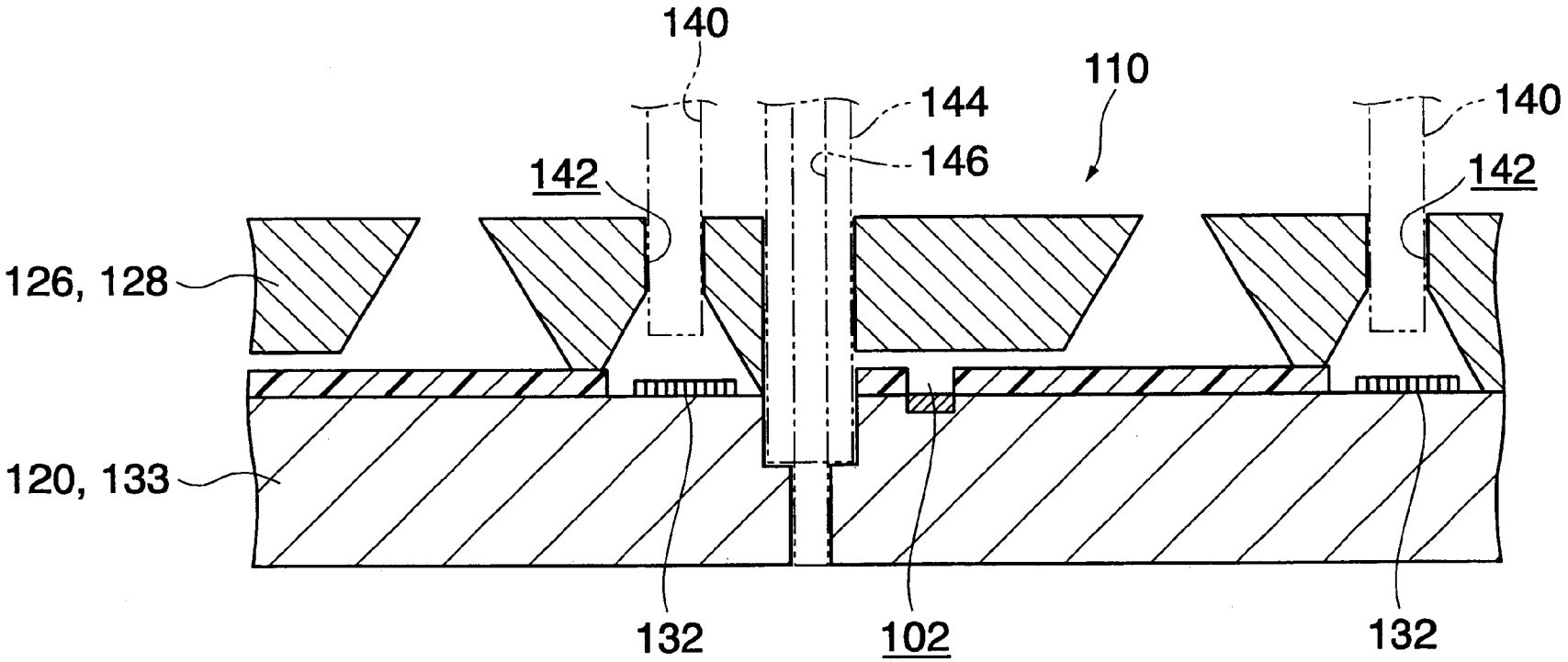
FIG. 17 PRIOR ART
FIG. 17 is an explanatory drawing showing the method of producing the head chip in the conventional example.
Figure 18A:
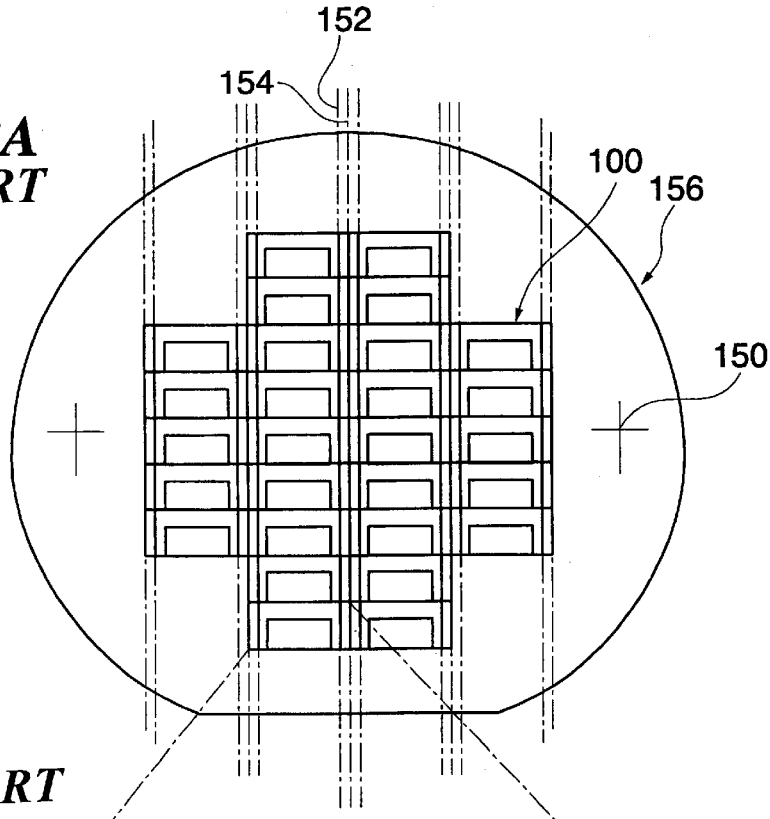
FIG. 18A PRIOR ART
FIG. 18A is an explanatory drawing showing a method of producing a head chip in another conventional example.
Figure 18B:
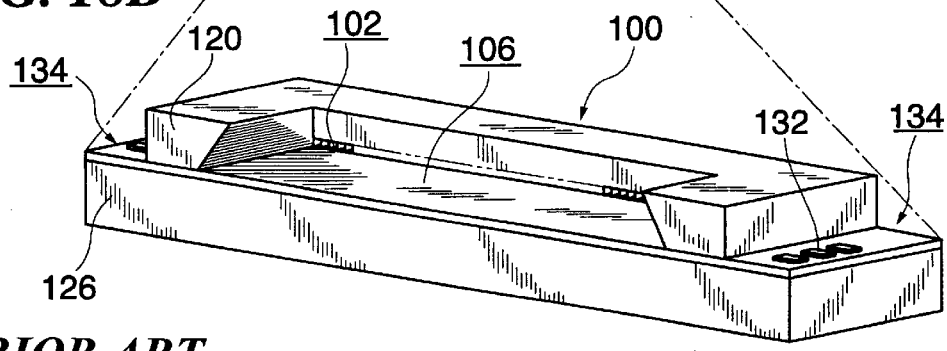
PRIOR ART FIG. 18B
FIG. 18B is a perspective view showing the back side of the head chip in another conventional example and FIG. 18C is a perspective view showing the front side of the head chip.
Figure 18C:
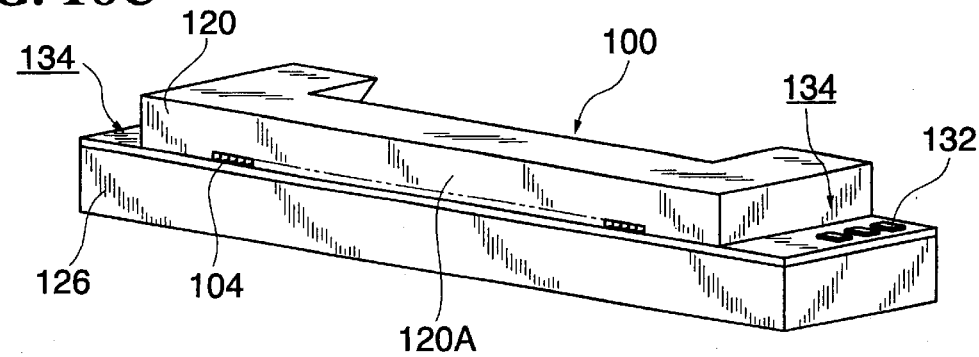
PRIOR ART FIG. 18C

Referring to FIG. 13, a sixth embodiment of the invention will be described below. The same reference numbers are allocated to the same components for those in the first to fifth embodiments and a detailed description is omitted.

FIG. 13 is a schematic perspective view showing an example of an ink jet recording device provided with the ink jet recording head in each embodiment.

An ink jet recording device 92 is provided with an ink feeder 80 loaded onto a carriage 96 carried along a guide shaft 94 and an ink jet recording head 10 (not limited to the first embodiment).

Ink is supplied from the ink feeder 80 to the ink jet recording head 10 and secure electric connection of the ink jet recording head 10 allows stable printing.

A record medium 98 may be all recordable media such as paper, a postal card and cloth. The record medium 98 is carried in a position opposite to the ink jet recording head 10 by a carriage mechanism.

According to the present invention, the degree of freedom in the design of the electric signal input-output terminal in the inkjet recording head is enhanced. In addition, the electric signal input-output terminal can be formed in a position hidden from the nozzle forming plane and it is possible to securely prevent failure in the electric signal input-output terminal during the production of the head chip.

The entire disclosure of Japanese Patent Application No. 2000-142495 filed on May 15, 2000 including specification, claims, drawings and abstract is incorporated herein by reference in its entirety.

What is claimed is:

1. An ink jet recording head which is formed by laminating a first substrate and a second substrate and between which an ink jetting mechanism is mounted, comprising:

a nozzle forming plane formed on the first substrate having a nozzle for jetting ink;

a side plane formed on the first substrate for defining a cut-out portion leaving a region of the side plane continuing to the nozzle forming plane; and an electric signal input-output terminal for electrically connecting to an external device, the electric signal input-output terminal being formed on the second substrate at a face joining to the first substrate, wherein the electric signal input-output terminal is exposed to an outside by forming the cut-out portion, the cut-out portion includes a plurality of facets that surround the electric signal input-output terminal, and at least one of the plurality of facets are not perpendicular to the joining face of the second substrate.

2. The inkjet recording head according to claim 1, wherein the cut-out portion is cut out from the side plane in a concave form.

3. An ink jet recording head, comprising:

a first substrate;

a second substrate on which the first substrate is laminated;

an ink jetting mechanism formed between the first substrate and the second substrate, such that the ink jetting mechanism includes at least one ink-jetting nozzle which is formed on a first plane of the first substrate and a cut-out portion which is formed on a second plane of the first substrate leaving a region of the second plane continuing to the first plane; and an electric signal input-output terminal for electrically connecting to an external device, the electric signal input-output terminal being formed on the second substrate at a face joining to the first substrate, wherein the electric signal input-output terminal is exposed outside by the cut-out portion, wherein the cut-out portion includes a plurality of facets that surround the electric signal input-output terminal, and at least one of the plurality of facets are not perpendicular to the joining face of the second substrate.

4. The ink jet recording head according to claim 3, wherein the cut-out portion is cut out from the second plane in a concave form.

5. The ink jet recording head according to claim 3, wherein the plurality of facets are two facets that open in two directions.

* * * * *